US011854734B2

(12) United States Patent
Matsuura

(10) Patent No.: US 11,854,734 B2
(45) Date of Patent: Dec. 26, 2023

(54) MULTILAYER COIL COMPONENT

(71) Applicant: Murata Manufacturing Co., Ltd., Kyoto-fu (JP)

(72) Inventor: Kouhei Matsuura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 615 days.

(21) Appl. No.: 17/115,680

(22) Filed: Dec. 8, 2020

(65) Prior Publication Data

US 2021/0183565 A1 Jun. 17, 2021

(30) Foreign Application Priority Data

Dec. 13, 2019 (JP) ..... 2019-225665

(51) Int. Cl.
*H01F 27/29* (2006.01)
*H01F 17/00* (2006.01)
*H01F 27/32* (2006.01)

(52) U.S. Cl.
CPC ..... *H01F 27/292* (2013.01); *H01F 17/0013* (2013.01); *H01F 27/324* (2013.01); *H01F 2017/0093* (2013.01)

(58) Field of Classification Search
CPC .. H01F 27/292; H01F 17/0013; H01F 27/324; H01F 2017/0093
See application file for complete search history.

(56) References Cited

U.S. PATENT DOCUMENTS 5,985,414 A * 11/1999 Fukuda ..... H01F 17/0013 428/209
2014/0145816 A1* 5/2014 Sato ..... H01F 5/06 336/208
2018/0047498 A1* 2/2018 Nakashima ..... H01F 17/0013
2018/0122563 A1* 5/2018 Matsuura ..... H01F 17/0013
2018/0350500 A1* 12/2018 Matsuura ..... H01F 17/06
2021/0012947 A1* 1/2021 Ishima ..... H01F 27/2804

FOREIGN PATENT DOCUMENTS

JP 2019-36698 A 3/2019

* cited by examiner

*Primary Examiner* — Marlon T Fletcher
*Assistant Examiner* — Malcolm Barnes
(74) *Attorney, Agent, or Firm* — Studebaker & Brackett PC

(57) ABSTRACT

A multilayer coil component includes an element body formed by stacking a plurality of insulating layers on top of one another, a coil buried inside the element body, and an outer electrode that is electrically connected to the coil. The dead weight of the multilayer coil component lies in a range from 0.2 mg to 0.35 mg. The element body has a mounting surface and has a coil lead-out surface to which the coil is electrically led out and on which the outer electrode is provided. Looking at a cross section of the element body that is perpendicular to the mounting surface and the coil lead-out surface, a radius of curvature of an edge portion where the mounting surface and the coil lead-out surface intersect lies in a range from 13 μm to 30 μm.

16 Claims, 5 Drawing Sheets

MULTILAYER COIL COMPONENT

CROSS-REFERENCE TO RELATED APPLICATION

This application claims benefit of priority to Japanese Patent Application No. 2019-225665, filed Dec. 13, 2019, the entire contents of which is incorporated herein by reference.

BACKGROUND

Technical Field

The present disclosure relates to a multilayer coil component.

Background Art

As an example of a multilayer coil component, for example, Japanese Unexamined Patent Application Publication No. 2019-36698 discloses a common mode noise filter that includes a plurality of rectangular insulator layers, first and second coils formed on the insulator layers, a rectangular-parallelepiped-shaped multilayer body including the insulator layers and the first and second coils, and first to fourth outer electrodes formed on the outside of the multilayer body.

Generally, a multilayer coil component has a pair of outer electrodes that are electrically connected to a single coil and the multilayer coil component is mounted on a wiring substrate by bonding the pair of outer electrodes to the wiring substrate using solder. However, if the balance between the tensile forces acting on the pair of outer electrodes from the solder is disturbed when mounting the multilayer coil component on the wiring substrate, one of the pair of outer electrodes may become separated from the wiring substrate and the multilayer coil component may end up in an upright posture on the wiring substrate, i.e., the so-called tombstone phenomenon (or Manhattan phenomenon) may occur. This tombstone phenomenon is more likely to occur, the smaller the dead weight of the multilayer coil component is. Therefore, in the case of the common mode noise filter disclosed in Japanese Unexamined Patent Application Publication No. 2019-36698 as well, there is a risk of the tombstone phenomenon being more likely to occur when the common mode noise filter is reduced in size and consequently dead weight.

SUMMARY

The present disclosure was made in order to solve the above-described problem and it is an object thereof to provide a multilayer coil component that is not susceptible to the tombstone phenomenon when being mounted.

A multilayer coil component according to a preferred embodiment of the present disclosure includes an element body formed by stacking a plurality of insulating layers on top of one another and an outer electrode that is electrically connected to the coil. The dead weight of the multilayer coil component lies in a range from 0.2 mg to 0.35 mg. The element body has a mounting surface and a coil lead-out surface to which the coil is electrically led out and on which the outer electrode is provided. Looking at a cross section of the element body that is perpendicular to the mounting surface and the coil lead-out surface, a radius of curvature of an edge portion where the mounting surface and the coil lead-out surface intersect lies in a range from 13 μm to 30 μm.

The preferred embodiment of the present disclosure can provide a multilayer coil component that is not susceptible to the tombstone phenomenon when being mounted.

Other features, elements, characteristics and advantages of the present disclosure will become more apparent from the following detailed description of preferred embodiments of the present disclosure with reference to the attached drawings.

DETAILED DESCRIPTION

Hereafter, a multilayer coil component according to an embodiment of the present disclosure will be described. However, the present disclosure is not limited to the following configurations and may be modified as appropriate within a range that does not depart from the gist of the present disclosure. In addition, configurations obtained by combining a plurality of the preferable configurations described hereafter are also included in the scope of the present disclosure.

Multilayer Coil Component

Figure 1:
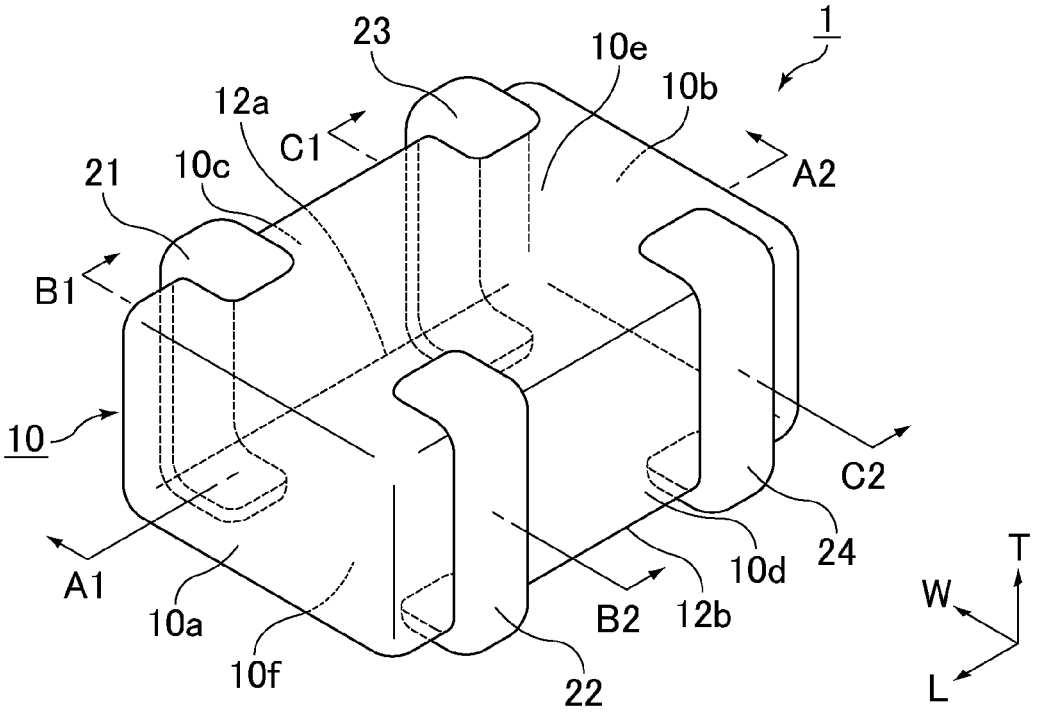
FIG. 1 is a schematic perspective view illustrating an example of a multilayer coil component of an embodiment of the present disclosure.

Hereafter, a common mode choke coil will be described as an example of a multilayer coil component according to an embodiment of the present disclosure. FIG. 1 is a schematic perspective view illustrating an example of a multilayer coil component of an embodiment of the present disclosure.

In this specification, a length direction, a width direction, and a height direction of the multilayer coil component are respectively taken to be directions defined by an arrow L, an arrow W, and an arrow T illustrated in FIG. 1 and so forth. Here, the length direction L, the width direction W, and the height direction T are perpendicular to each other.

As illustrated in FIG. 1, a multilayer coil component 1 includes an element body 10, a first outer electrode 21, a second outer electrode 22, a third outer electrode 23, and a fourth outer electrode 24. The multilayer coil component 1 is a common mode choke coil and although not illustrated in FIG. 1, also includes a first coil and a second coil that are buried inside the element body 10.

The element body 10 has for example a substantially rectangular parallelepiped shape having six surfaces, as illustrated in FIG. 1. The element body 10 has a first end surface 10*a* and a second end surface 10*b* that face each other in the length direction L, a first side surface 10*c* and a second side surface 10*d* that face each other in the width direction W, and a first main surface 10*e* and a second main surface 10*f* that face each other in the height direction T.

The first main surface 10*e* or the second main surface 10*f* of the element body 10 serves as a mounting surface when mounting the multilayer coil component 1 on a wiring substrate. Hereafter, the case where the second main surface 10*f* is used as the mounting surface will be described, but the same description would also apply to the case where the first main surface 10*e* is used as the mounting surface.

In the element body 10, a plurality of insulating layers are stacked on top of one another in the height direction T, as will be described later.

The first outer electrode 21 is provided on part of the first side surface 10*c* of the element body 10 and extends from the first side surface 10*c* onto part of the first main surface 10*e* and part of the second main surface 10*f*.

The second outer electrode 22 is provided on part of the second side surface 10*d* of the element body 10 and extends from the second side surface 10*d* onto part of the first main surface 10*e* and part of the second main surface 10*f*. Furthermore, the second outer electrode 22 is provided at a position that faces the first outer electrode 21 in the width direction W.

The third outer electrode 23 is provided on part of the first side surface 10*c* of the element body 10 at a position that is separated from the first outer electrode 21 and extends from the first side surface 10*c* onto part of the first main surface 10*e* and part of the second main surface 10*f*.

The fourth outer electrode 24 is provided on part of the second side surface 10*d* of the element body 10 at a position that is separated from the second outer electrode 22 and extends from the second side surface 10*d* onto part of the first main surface 10*e* and part of the second main surface 10*f*. Furthermore, the fourth outer electrode 24 is provided at a position that faces the third outer electrode 23 in the width direction W.

The first outer electrode 21, the second outer electrode 22, the third outer electrode 23, and the fourth outer electrode 24 may each have a single-layer structure or a multilayer structure.

In the case where the first outer electrode 21, the second outer electrode 22, the third outer electrode 23, and the fourth outer electrode 24 each have a single-layer structure, for example, Ag, Au, Cu, Pd, Ni, or Al or an alloy of any of these metals may be used as the material forming the outer electrodes.

In the case where the first outer electrode 21, the second outer electrode 22, the third outer electrode 23, and the fourth outer electrode 24 each have a multilayer structure, the outer electrodes may each include for example a base electrode layer containing Ag, a Ni plating film, and a Sn plating film stacked in this order from the surface of the element body 10.

Figure 2:
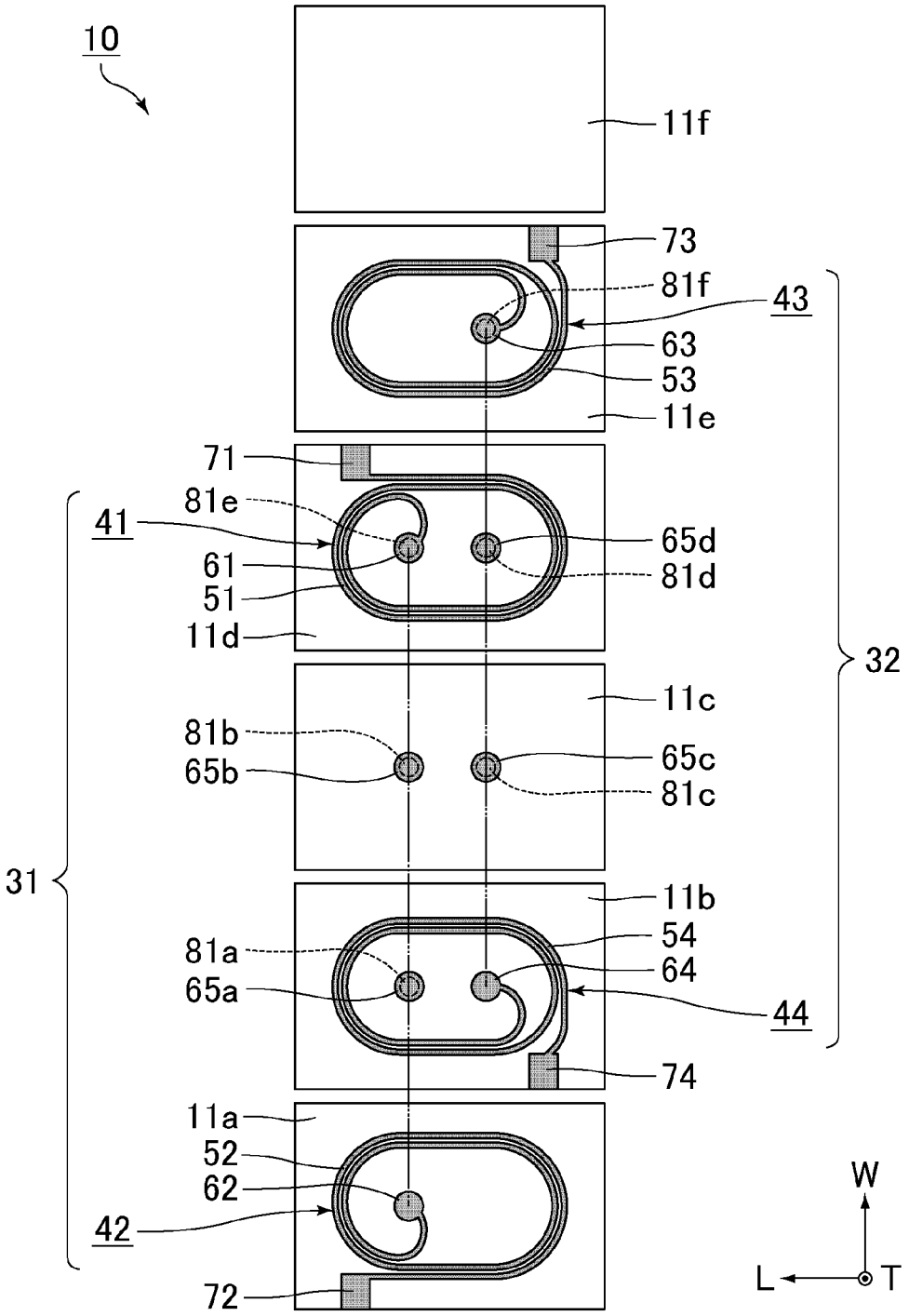
FIG. 2 is an exploded schematic plan view illustrating an example of the internal structure of an element body in FIG. 1.
Figure 3:
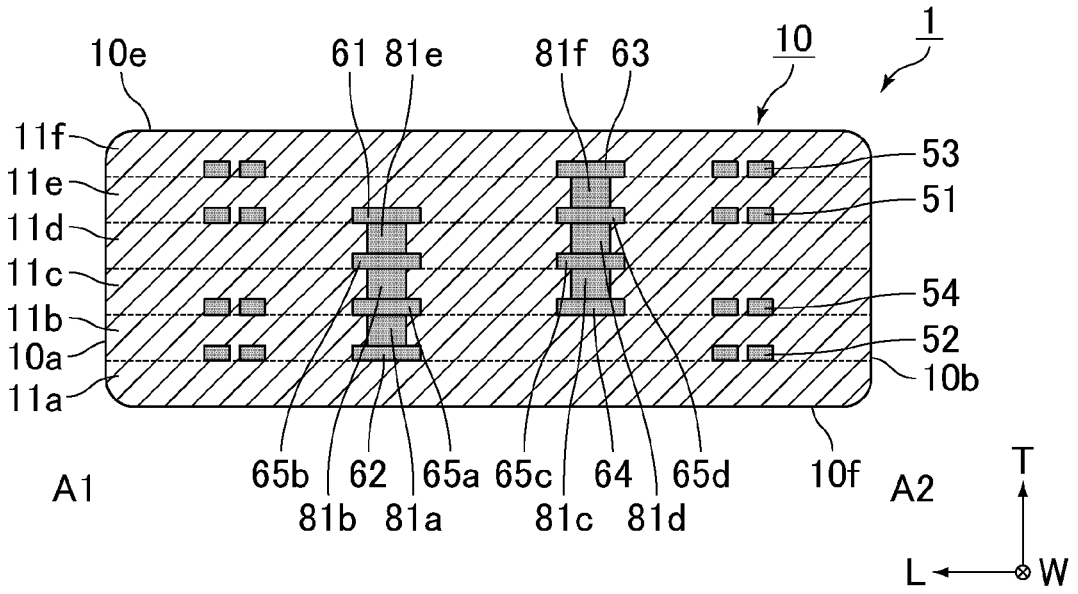
FIG. 3 is a schematic sectional view taken along line A1-A2 in FIG. 1.
Figure 4:
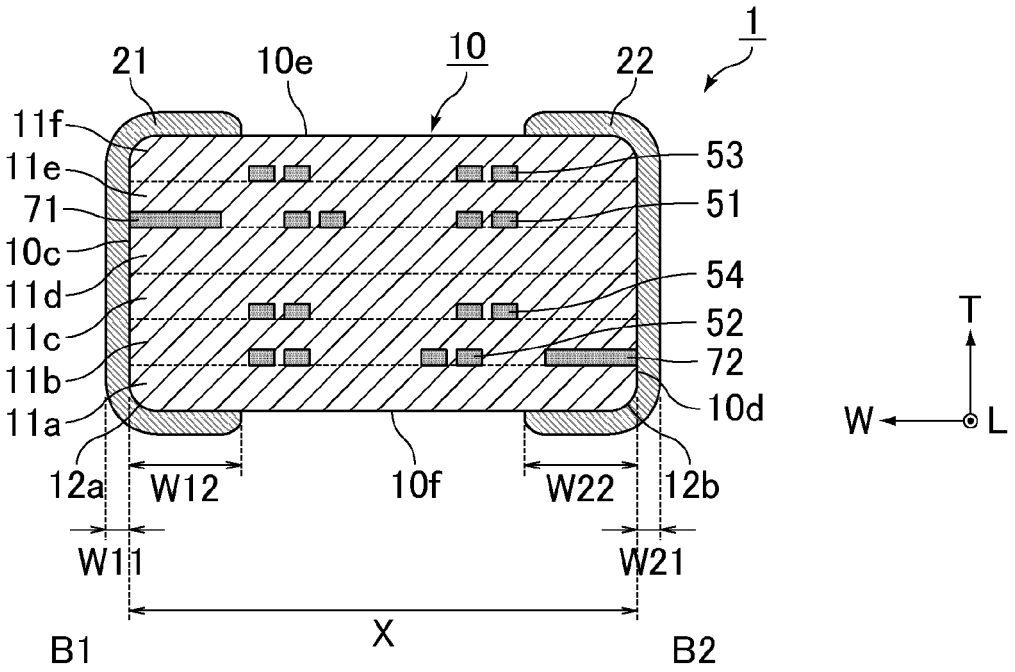
FIG. 4 is a schematic sectional view taken along line B1-B2 in FIG. 1.
Figure 5:
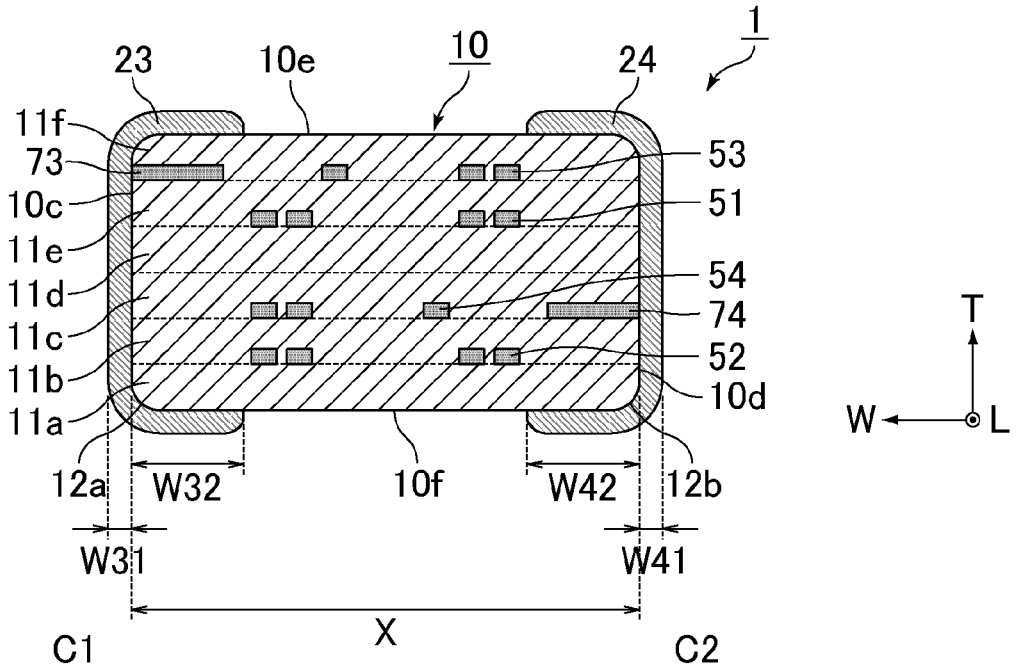
FIG. 5 is a schematic sectional view taken along line C1-C2 in FIG. 1.

FIG. 2 is an exploded schematic plan view illustrating an example of the internal structure of the element body 10 in FIG. 1. FIG. 3 is a schematic sectional view taken along line A1-A2 in FIG. 1. FIG. 4 is a schematic sectional view taken along line B1-B2 in FIG. 1. FIG. 5 is a schematic sectional view taken along line C1-C2 in FIG. 1.

As illustrated in FIGS. 2, 3, 4, and 5, the element body 10 is formed by stacking, in the height direction T, a plurality of insulating layers including an insulating layer 11*a*, an insulating layer 11*b*, an insulating layer 11*c*, an insulating layer 11*d*, and an insulating layer 11*e*. In the element body 10, the insulating layer 11*a* is located at the side near the second main surface 10*f* and the insulating layer 11*e* is located at the side near the first main surface 10*e*. In FIGS. 3, 4, and 5, the boundaries between these insulating layers are illustrated as dotted lines for convenience of explanation, but these boundaries may not clearly appear in reality.

The insulating layer 11*a*, the insulating layer 11*b*, the insulating layer 11*c*, the insulating layer 11*d*, and the insulating layer 11*e* are preferably formed of the same material.

In the element body 10, at least one insulating layer that is not provided with a coil conductor, a lead-out electrode, a via conductor, or the like, which are described later, may be stacked on at least either one of the side of the insulating layer 11*a* near the second main surface 10*f* and the side of the insulating layer 11*e* near the first main surface 10*e*. For example, in the element body 10, an insulating layer 11*f* may be stacked on the side of the insulating layer 11*e* near the first main surface 10*e*, as illustrated in FIGS. 2, 3, 4, and 5. This extra insulating layer 11*f* is preferably formed of the same material as the insulating layer 11*a*, the insulating layer 11*b*, the insulating layer 11*c*, the insulating layer 11*d*, and the insulating layer 11*e*.

A first coil 31 and a second coil 32 are buried inside the element body 10.

The first coil 31 is formed by stacking a first coil conductor 41 and a second coil conductor 42 together with the insulating layers in the height direction T and electrically connecting the first coil conductor 41 and the second coil conductor 42 to each other. In addition, the second coil 32 is formed by stacking a third coil conductor 43 and a fourth coil conductor 44 together with the insulating layers in the height direction T and electrically connecting the third coil conductor 43 and the fourth coil conductor 44 to each other. This is described in more detail hereafter.

The second coil conductor 42 is provided on a main surface of the insulating layer 11*a*. The second coil conductor 42 includes a second line portion 52 and a second land portion 62. One end of the second line portion 52 is connected to a second lead-out electrode 72 that is led out from the second outer electrode 22. The other end of the second line portion 52 is connected to the second land portion 62.

The fourth coil conductor 44 is provided on a main surface of the insulating layer 11*b*. The fourth coil conductor 44 includes a fourth line portion 54 and a fourth land portion 64. One end of the fourth line portion 54 is connected to a fourth lead-out electrode 74 that is led out from the fourth outer electrode 24. The other end of the fourth line portion 54 is connected to the fourth land portion 64.

A land portion 65*a* is provided on the main surface of the insulating layer 11*b* at a position that is separated from the fourth land portion 64. In addition, a via conductor 81*a* that penetrates through the insulating layer 11*b* in the height direction T is provided at a position that overlaps the land portion 65*a*.

A land portion 65*b* is provided on a main surface of the insulating layer 11*c*. In addition, a via conductor 81*b* that penetrates through the insulating layer 11*c* in the height direction T is provided at a position that overlaps the land portion 65*b*.

A land portion 65*c* is provided on the main surface of the insulating layer 11*c* at a position that is separated from the land portion 65*b*. In addition, a via conductor 81*c* that penetrates through the insulating layer 11*c* in the height direction T is provided at a position that overlaps the land portion 65*c*.

The first coil conductor 41 is provided on a main surface of the insulating layer 11*d*. The first coil conductor 41 includes a first line portion 51 and a first land portion 61. One end of the first line portion 51 is connected to a first lead-out electrode 71 that is led out from the first outer electrode 21. The other end of the first line portion 51 is connected to the first land portion 61.

A via conductor 81*e* that penetrates through the insulating layer 11*d* in the height direction T is provided at a position that overlaps the first land portion 61.

A land portion 65*d* is provided on the main surface of the insulating layer 11*d* at a position that is separated from the first land portion 61. In addition, a via conductor 81*d* that penetrates through the insulating layer 11*d* in the height direction T is provided at a position that overlaps the land portion 65*d*.

The third coil conductor 43 is provided on a main surface of the insulating layer 11*e*. The third coil conductor 43 includes a third line portion 53 and a third land portion 63. One end of the third line portion 53 is connected to a third lead-out electrode 73 that is led out from the third outer electrode 23. The other end of the third line portion 53 is connected to the third land portion 63.

A via conductor 81*f* that penetrates through the insulating layer 11*e* in the height direction T is provided at a position that overlaps the third land portion 63.

When the insulating layer 11*a*, the insulating layer 11*b*, the insulating layer 11*c*, the insulating layer 11*d*, and the insulating layer 11*e*, which have been provided with the coil conductors, the lead-out electrodes, via conductors, and so forth as described above, are stacked in this order in the height direction T, the first land portion 61 of the first coil conductor 41 is electrically connected to the second land portion 62 of the second coil conductor 42 by the via conductor 81*e*, the land portion 65*b*, the via conductor 81*b*, the land portion 65*a*, and the via conductor 81*a* in this order, as illustrated in FIGS. 2 and 3. Thus, the first coil 31 is formed. Furthermore, the third land portion 63 of the third coil conductor 43 is electrically connected to the fourth land portion 64 of the fourth coil conductor 44 by the via conductor 81*f*, the land portion 65*d*, the via conductor 81*d*, the land portion 65*c*, and the via conductor 81*c* in this order. Thus, the second coil 32 is formed.

As illustrated in FIGS. 2 and 4, one end of the first coil 31 (one end of first line portion 51) is electrically led out to the first side surface 10*c* of the element body 10 via the first lead-out electrode 71 and the first outer electrode 21 is provided on the first side surface 10*c* of the element body 10. Thus, the one end of the first coil 31 is electrically connected to the first outer electrode 21 via the first lead-out electrode 71.

In addition, the other end of the first coil 31 (one end of second line portion 52) is electrically led out to the second side surface 10*d* of the element body 10 via the second lead-out electrode 72 and the second outer electrode 22 is provided on the second side surface 10*d* of the element body 10. Thus, the other end of the first coil 31 is electrically connected to the second outer electrode 22 via the second lead-out electrode 72.

As illustrated in FIGS. 2 and 5, one end of the second coil 32 (one end of third line portion 53) is electrically led out to the first side surface 10*c* of the element body 10 via the third lead-out electrode 73 and the third outer electrode 23 is provided on the first side surface 10*c* of the element body 10. Thus, the one end of the second coil 32 is electrically connected to the third outer electrode 23 via the third lead-out electrode 73.

In addition, the other end of the second coil 32 (one end of fourth line portion 54) is electrically led out to the second side surface 10*d* of the element body 10 via the fourth lead-out electrode 74 and the fourth outer electrode 24 is provided on the second side surface 10*d* of the element body 10. Thus, the other end of the second coil 32 is electrically connected to the fourth outer electrode 24 via the fourth lead-out electrode 74.

From the above description, the first side surface 10*c* and the second side surface 10*d* of the element body 10 serve as coil lead-out surfaces of the multilayer coil component 1.

The coil axes of the first coil 31 and the second coil 32 extend in the height direction T through the centers of the cross-sectional shapes of the coils when a cross section is viewed in the height direction T.

In a cross section viewed in the height direction T, the outer shapes of the first coil 31 and the second coil 32 may each substantially be a shape consisting of straight and curved line sections as illustrated in FIG. 2 or may be substantially circular or polygonal shapes.

In the cross section viewed in the height direction T, the first land portion 61, the second land portion 62, the third land portion 63, the fourth land portion 64, the land portion 65*a*, the land portion 65*b*, the land portion 65*c*, and the land portion 65*d* may have substantially circular shapes as illustrated in FIG. 2 or may have substantially polygonal shapes.

For example, Ag, Au, Cu, Pd, Ni, Al or an alloy of any of these metals may be used as the constituent materials of the first line portion 51, the second line portion 52, the third line portion 53, the fourth line portion 54, the first land portion 61, the second land portion 62, the third land portion 63, the fourth land portion 64, the land portion 65*a*, the land portion 65*b*, the land portion 65*c*, the land portion 65*d*, the first lead-out electrode 71, the second lead-out electrode 72, the third lead-out electrode 73, the fourth lead-out electrode 74, the via conductor 81*a*, the via conductor 81*b*, the via conductor 81*c*, the via conductor 81*d*, the via conductor 81*e*, and the via conductor 81*f*.

The dead weight of the multilayer coil component 1 lies in a range substantially from 0.2 mg to 0.35 mg.

The dead weight of the multilayer coil component 1 is measured using an electronic balance.

In the multilayer coil component 1, looking at a cross section of the element body 10 that is perpendicular to the second main surface 10*f*, which is the mounting surface, and the first side surface 10*c*, which is a coil lead-out surface, more specifically, looking at a cross section of the element body 10 illustrated in FIG. 4 or 5, the radius of curvature of a first edge portion 12*a* where the second main surface 10*f* and the first side surface 10*c* intersect lies in a range substantially from 13 μm to 30 μm. In addition, looking at a cross section of the element body 10 that is perpendicular to the second main surface 10*f*, which is the mounting surface, and the second side surface 10*d*, which is a coil lead-out surface, more specifically, looking at a cross section of the element body 10 illustrated in FIG. 4 or 5, the radius of curvature of a second edge portion 12*b* where the second main surface 10*f* and the second side surface 10*d* intersect lies in a range substantially from 13 μm to 30 μm.

Since the radius of curvature of the first edge portion 12*a* lies in the above-described range, the parts of the first outer electrode 21 and the third outer electrode 23 opposite the first edge portion 12*a* will also have a similar radius of curvature and consequently the multilayer coil component 1 (element body 10) will not be susceptible to rotating with the first edge portion 12*a* acting as a starting point. Furthermore, since the radius of curvature of the second edge portion 12*b* lies in the above-described range, the parts of the second outer electrode 22 and the fourth outer electrode 24 opposite the second edge portion 12*b* will also have a similar radius of curvature and consequently the multilayer coil component 1 (element body 10) will not be susceptible to rotating with the second edge portion 12*b* acting as a starting point. Therefore, when the multilayer coil component 1 is mounted on the wiring substrate from the second main surface 10*f* side (mounting surface side) of the element body 10 by bonding the first outer electrode 21, the second outer electrode 22, the third outer electrode 23, and the fourth outer electrode 24 to the wiring substrate via solder, the tombstone phenomenon is unlikely to occur even when the dead weight of the multilayer coil component 1 is small such as in the range from 0.2 mg to 0.35 mg as described above.

When the radius of curvature of the first edge portion 12*a* is smaller than 13 μm, the part of the element body 10 where the first edge portion 12*a* is exposed and the parts of the first outer electrode 21 and the third outer electrode 23 opposite the first edge portion 12*a* are susceptible to damage such as becoming cracked, chipped or the like due to an external impact during mounting of the multilayer coil component 1. In addition, when the radius of curvature of the second edge portion 12*b* is smaller than 13 μm, the part of the element body 10 where the second edge portion 12*b* is exposed and the parts of the second outer electrode 22 and the fourth outer electrode 24 opposite the second edge portion 12*b* are susceptible to damage such as becoming cracked, chipped or the like due to an external impact during mounting of the multilayer coil component 1.

When the radius of curvature of the first edge portion 12*a* is larger than 30 μm, the multilayer coil component 1 (element body 10) is susceptible to rotating with the first edge portion 12*a* acting as a starting point. In addition, when the radius of curvature of the second edge portion 12*b* is larger than 30 μm, the multilayer coil component 1 (element body 10) is susceptible to rotating with the second edge portion 12*b* acting as a starting point. Therefore, the tombstone phenomenon would be likely to occur when the multilayer coil component 1 is mounted on the wiring substrate from the second main surface 10*f* side of the element body 10.

So long as the radii of curvature of the first edge portion 12*a* and the second edge portion 12*b* lie in a range substantially from 13 μm to 30 μm, the radii of curvature may be the same as each other or different from each other.

The radius of curvature of the first edge portion 12*a* is measured using a measurement microscope by grinding down the multilayer coil component 1 so as to expose a WT cross section that is parallel to the width direction W and the height direction T. Measurement of the radius of curvature is preferably carried out at a part of the first edge portion 12*a* that is opposite the first outer electrode 21 or the third outer electrode 23 in the cross section illustrated in FIG. 4 or 5.

The radius of curvature of the second edge portion 12*b* is measured in the same manner as the radius of curvature of the first edge portion 12*a*.

The edge portions of the element body 10 other than the first edge portion 12*a* and the second edge portion 12*b* may be rounded, the corner portions of the element body 10 may be rounded, or both the edge portions and the corner portions may be rounded. The corner portions of the element body 10 are the parts of the element body 10 where three surfaces intersect.

Looking at a cross section perpendicular to the second main surface 10*f* and the first side surface 10*c*, more specifically, the cross section illustrated in FIG. 4, the sum of a dimension W11 of the part of the first outer electrode 21 on the first side surface 10*c* in a direction parallel to the second main surface 10*f* (width direction W) and a dimension W12 of the part of the first outer electrode 21 that extends along the second main surface 10*f* preferably lies in a range substantially from 70 μm to 140 μm.

Looking at a cross section perpendicular to the second main surface 10*f* and the second side surface 10*d*, more specifically, the cross section illustrated in FIG. 4, the sum of a dimension W21 of the part of the second outer electrode 22 on the second side surface 10*d* in a direction parallel to the second main surface 10*f* (width direction W) and a dimension W22 of the part of the second outer electrode 22 that extends along the second main surface 10*f* preferably lies in a range substantially from 70 μm to 140 μm.

Looking at a cross section perpendicular to the second main surface 10*f* and the first side surface 10*c*, more specifically, the cross section illustrated in FIG. 5, the sum of a dimension W31 of the part of the third outer electrode 23 on the first side surface 10*c* in a direction parallel to the second main surface 10*f* (width direction W) and a dimension W32 of the part of the third outer electrode 23 that extends along the second main surface 10*f* preferably lies in a range substantially from 70 μm to 140 μm.

Looking at a cross section perpendicular to the second main surface 10*f* and the second side surface 10*d*, more specifically, the cross section illustrated in FIG. 5, the sum of a dimension W41 of the part of the fourth outer electrode 24 on the second side surface 10*d* in a direction parallel to the second main surface 10*f* (width direction W) and a dimension W42 of the part of the fourth outer electrode 24 that extends along the second main surface 10*f* preferably lies in a range substantially from 70 μm to 140 μm.

By making the sum of the dimension W11 and the dimension W12, the sum of the dimension W21 and the dimension W22, the sum of the dimension W31 and the dimension W32, and the sum of the dimension W41 and the dimension W42 lie within the above-described range, the tombstone phenomenon is unlikely to occur when mounting the multilayer coil component 1 on the wiring substrate from the second main surface 10*f* side of the element body 10.

When the sum of the dimension W11 and the dimension W12, the sum of the dimension W21 and the dimension W22, the sum of the dimension W31 and the dimension W32, and the sum of the dimension W41 and the dimension W42 are smaller than 70 μm, there is a large area of contact between the element body 10 and solder when the multilayer coil component 1 is mounted on the wiring substrate with solder. Therefore, the tombstone phenomenon may be more likely to occur due to the solder causing the stacked coil component 1 (element body 10) to spring up.

When the sum of the dimension W11 and the dimension W12, the sum of the dimension W21 and the dimension W22, the sum of the dimension W31 and the dimension W32, and the sum of the dimension W41 and the dimension W42 are greater than 140 μm, the insulation resistance may be reduced due to the dimensions of the outer electrodes in the length direction L also being increased when the first outer electrode 21, the second outer electrode 22, the third outer electrode 23, and the fourth outer electrode 24 are formed.

The sum of the dimension W11 and the dimension W12, the sum of the dimension W21 and the dimension W22, the sum of the dimension W31 and the dimension W32, and the sum of the dimension W41 and the dimension W42 may be the same as each other or different from each other.

The dimension W11, the dimension W12, the dimension W21, the dimension W22, the dimension W31, the dimension W32, the dimension W41, and the dimension W42 are measured using a measurement microscope by grinding down the multilayer coil component 1 so as to expose a WT cross section that is parallel to the width direction W and the height direction T.

The dimension W11, the dimension W12, the dimension W21, the dimension W22, the dimension W31, the dimension W32, the dimension W41, and the dimension W42 indicate the maximum dimensions of the respective parts.

A distance X between the first side surface 10*c* and the second side surface 10*d*, which face each other in the width direction W, as illustrated in FIGS. 4 and 5, may lie in a range substantially from 0.45 mm to 0.55 mm. In this case, the distance X between the first side surface 10*c* and the second side surface 10*d* is identical to the distance in the width direction W between the parts of the first outer electrode 21 and the second outer electrode 22 that face each other with the element body 10 interposed therebetween and is identical to the distance in the width direction W between the parts of the third outer electrode 23 and the fourth outer electrode 24 that face each other with the element body 10 interposed therebetween.

In the multilayer coil component 1, the first outer electrode 21 and the second outer electrode 22, which are a pair of outer electrodes that are electrically connected to the first coil 31, are provided on the first side surface 10*c* and the second side surface 10*d*, which face each other in the width direction W. Therefore, as is clear from FIG. 1, the distance between the first outer electrode 21 and the second outer electrode 22 is shorter than the distance would be in a case where the first outer electrode 21 and the second outer electrode 22 are provided on the first end surface 10*a* and the second end surface 10*b*, which face each other in the length direction L. In addition, in the multilayer coil component 1, the third outer electrode 23 and the fourth outer electrode 24, which are a pair of outer electrodes that are electrically connected to the second coil 32, are provided on the first side surface 10*c* and the second side surface 10*d*, which face each other in the width direction W. Therefore, as is clear from FIG. 1, the distance between the third outer electrode 23 and the fourth outer electrode 24 is shorter than the distance would be in a case where the third outer electrode 23 and the fourth outer electrode 24 are provided on the first end surface 10*a* and the second end surface 10*b*, which face each other in the length direction L. When the distances between the pairs of outer electrodes are short, the tombstone phenomenon is usually more likely to occur when mounting the multilayer coil component. In contrast, according to the multilayer coil component 1, the tombstone phenomenon is unlikely to occur when mounting the multilayer coil component 1 even when the distance X between the first side surface 10*c* and the second side surface 10*d* lies with the above-described range substantially from 0.45 mm to 0.55 mm. In other words, the tombstone phenomenon is unlikely to occur when mounting the multilayer coil component 1 even when the distance in the width direction W between the parts of the first outer electrode 21 and the second outer electrode 22 that face each other with the element body 10 interposed therebetween and the distance in the width direction W between the parts of the third outer electrode 23 and the fourth outer electrode 24 that face each other with the element body 10 interposed therebetween lie in the above-described range substantially from 0.45 mm to 0.55 mm.

The distance X between the first side surface 10*c* and the second side surface 10*d* is measured using a measurement microscope by grinding down the multilayer coil component 1 so as to expose a WT cross section that is parallel to the width direction W and the height direction T.

The plurality of insulating layers forming the element body 10, in this case, the insulating layer 11*a*, the insulating layer 11*b*, the insulating layer 11*c*, the insulating layer 11*d*, the insulating layer 11*e*, and the insulating layer 11*f* may be formed of a glass ceramic material. A glass ceramic material has a lower specific gravity than a ferrite material, which is another example of a material that may form insulating layers. According to the multilayer coil component 1, the tombstone phenomenon is unlikely to occur when mounting the multilayer coil component 1 even when the plurality of insulating layers forming the element body 10 are formed of a glass ceramic material having a low specific gravity. Furthermore, the radio-frequency characteristics of the multilayer coil component 1 serving as a common mode choke coil are improved by the plurality of insulating layers forming the element body 10 being formed of a glass ceramic material.

It is preferable that the glass ceramic material contain a glass material at least including K, B, and Si.

The glass material preferably contains $K_2O$ at substantially 0.5 wt % to 5 wt % as K content, $B_2O_3$ at substantially 10 wt % to 25 wt % as B content, $SiO_2$ at substantially 70 wt % to 85 wt % as Si content, and $Al_2O_3$ at 0 wt % to 5 wt % as Al content.

The glass ceramic material preferably includes $SiO_2$ (quartz) and $Al_2O_3$ (alumina) in addition to the above-described glass material. In this case, the glass ceramic material preferably contains the glass material at substantially 60 wt % to 66 wt %, $SiO_2$ as a filler at substantially 34 wt % to 37 wt %, and $Al_2O_3$ as a filler at substantially 0.5 wt % to 4 wt %. The radio-frequency characteristics of the multilayer coil component 1 serving as a common mode choke coil are improved as a result of the glass ceramic material containing $SiO_2$ as a filler. In addition, the mechanical strength of the element body 10 is increased as a result of the glass ceramic material containing $Al_2O_3$ as a filler.

Although the multilayer coil component 1 is provided with four outer electrodes, the number of outer electrodes is not limited to four and for example may be two as described below.

Figure 6:
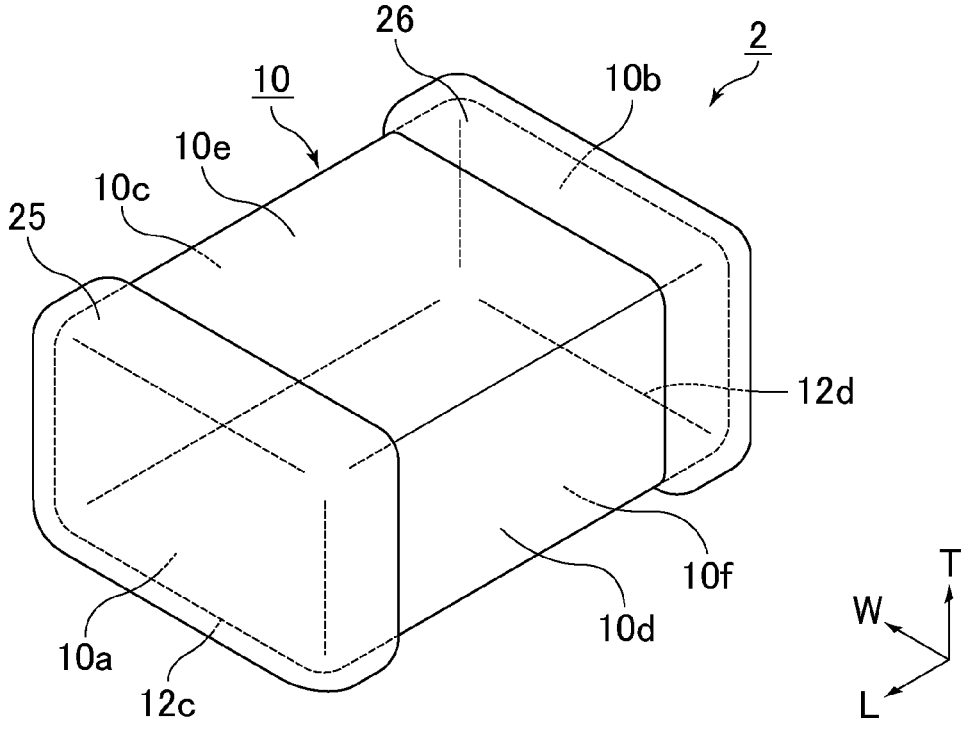
FIG. 6 is a schematic perspective view illustrating another example of a multilayer coil component of an embodiment of the present disclosure.

FIG. 6 is a schematic perspective view illustrating another example of a multilayer coil component of an embodiment of the present disclosure. As illustrated in FIG. 6, a multilayer coil component 2 includes an element body 10, a fifth outer electrode 25, and a sixth outer electrode 26. Furthermore, although not illustrated in FIG. 6, the multilayer coil component 2 also includes a coil that is electrically connected to the fifth outer electrode 25 and the sixth outer electrode 26 and is buried inside the element body 10.

In the multilayer coil component 2, one end of the coil is electrically led out to a first end surface 10*a* of the element body 10 and the fifth outer electrode 25 is provided on the first end surface 10*a* of the element body 10. Furthermore, the other end of the coil is electrically led out to a second end surface 10*b* of the element body 10 and the sixth outer electrode 26 is provided on the second end surface 10*b* of the element body 10.

From the above description, in the multilayer coil component 2, the first end surface 10*a* and the second end surface 10*b* of the element body 10 serve as coil lead-out surfaces.

In the multilayer coil component 2, looking at a cross section of the element body 10 that is perpendicular to the second main surface 10*f*, which is the mounting surface, and the first end surface 10*a*, which is a coil lead-out surface, more specifically, looking at an LT cross section that is parallel to the length direction L and the height direction T, the radius of curvature of a third edge portion 12*c* where the second main surface 10*f* and the first end surface 10*a* intersect lies in a range substantially from 13 μm to 30 μm. In addition, looking at a cross section of the element body 10 that is perpendicular to the second main surface 10*f*, which is the mounting surface, and the second end surface 10*b*, which is a coil lead-out surface, more specifically, looking at an LT cross section that is parallel to the length direction L and the height direction T, the radius of curvature of a fourth edge portion 12*d* where the second main surface 10*f* and the second end surface 10*b* intersect lies in a range substantially from 13 μm to 30 μm.

Method of Manufacturing Multilayer Coil Component

The multilayer coil component according to the embodiment of the present disclosure is manufactured using the following method, for example.

Preparation of Glass Ceramic Material $K_2O$, $B_2O_3$, $SiO_2$, $Al_2O_3$, and so forth are mixed at a prescribed ratio. The obtained mixture is then melted by being fired. After that, the glass material is prepared by quenching the obtained melted material. Next, the glass ceramic material is prepared by adding $SiO_2$ (quartz) and $Al_2O_3$ (alumina) as fillers to the glass material.

Preparation of Glass Ceramic Sheets

A ceramic slurry is prepared by adding an organic binder such as polyvinyl butyral resin, an organic solvent such as ethanol or toluene, a plasticizer, and so forth to the glass ceramic material and mixing the materials together. Glass ceramic sheets are then prepared by forming the ceramic slurry into a substantially sheet-like shape using a doctor blade method or the like and then punching predetermined shapes out of the sheet.

Formation of Conductor Patterns

Coil-conductor conductor patterns corresponding to the coil conductors illustrated in FIG. 2, lead-out-electrode conductor patterns corresponding to the lead-out electrodes illustrated in FIG. 2, and via-conductor conductor patterns corresponding to the via conductors illustrated in FIG. 2 are formed on and in the glass ceramic sheets by performing screen printing or the like using an electrically conductive paste such as a Ag paste. When forming the via-conductor conductor patterns, via holes are formed first by irradiating predetermined regions of the glass-ceramic sheets with a laser and then the thus-formed via holes are filled with the electrically conductive paste.

Preparation of Multilayer Block

The glass ceramic sheets having the conductor patterns formed thereon and therein are stacked in the order illustrated in FIG. 2. A prescribed number of glass ceramic sheets having no conductor patterns formed thereon or therein may be stacked on the top and bottom of this multilayer body. After that, a multilayer block is prepared by subjecting the obtained multilayer body to pressure bonding using a warm isostatic press (WIP) or the like.

Preparation of Element Body

Individual chips are prepared by cutting the multilayer block into pieces of a prescribed size using a dicer or the like. Then, the individual chips are fired and as a result, the glass ceramic sheets become the insulating layers and the coil-conductor conductor patterns, the lead-out-electrode conductor patterns, and the via-conductor conductor patterns become the coil conductors, the lead-out electrodes, and the via conductors. As a result, element bodies each having the first coil and the second coil buried therein as illustrated in FIG. 2 are prepared.

The prepared element body has a first end surface and a second end surface that face each other in the length direction, a first side surface and a second side surface that face each other in the width direction, and a first main surface and a second main surface that face each other in the height direction. The second main surface of the element body is regarded as the mounting surface in this manufacturing method.

Furthermore, the first lead-out electrode, which is connected to one end of the first coil, and the third lead-out electrode, which is connected to one end of the second coil, are exposed at the first side surface of the element body. The second lead-out electrode, which is connected to the other end of the first coil, and the fourth lead-out electrode, which is connected to the other end of the second coil, are exposed at the second side surface of the element body. In other words, in this manufacturing method, the first side surface and the second side surface of the element body serve as coil lead-out surfaces.

Next, the first edge portion where the second main surface, which is the mounting surface, and the first side surface, which is a coil lead-out surface, intersect is rounded so that the radius of curvature thereof comes to be in a range substantially from 13 μm to 30 μm by subjecting the element body to barrel polishing, for example. Similarly, the second edge portion where the second main surface, which is the mounting surface, and the second side surface, which is a coil lead-out surface, intersect is rounded so that the radius of curvature thereof comes to be in a range substantially from 13 μm to 30 μm. The edge portions of the element body other than the first edge portion and the second edge portion may be rounded, the corner portions of the element body may be rounded, or both the edge portions and the corner portions may be rounded when the element body is subjected to barrel polishing.

Formation of Outer Electrodes

An electrically conductive paste containing Ag and glass frit is applied to at least the four places where the lead-out electrodes are exposed on both side surfaces of the element body. Then, base electrode layers are formed by baking the thus-obtained films. Next, a Ni plating film and a Sn plating film are sequentially formed by performing electrolytic plating on the base electrode layers. As a result, the first outer electrode, the second outer electrode, the third outer electrode, and the fourth outer electrode as illustrated in FIG. 1 are formed.

The multilayer coil component according to the embodiment of the present disclosure as exemplified in FIGS. 1, 2, and so forth is manufactured as described above.

EXAMPLES

Hereafter, examples that disclose the multilayer coil component according to the embodiment of the present disclosure in a more specific manner will be described. The present disclosure is not limited to just the following examples.

Example 1

A multilayer coil component of example 1 was manufactured using the following method.

Preparation of Glass Ceramic Material $K_2O$, $B_2O_3$, $SiO_2$, and $Al_2O_3$ were weighed at a prescribed ratio and mixed in a platinum crucible. Then, the resulting mixture was melted by being fired at a temperature in a range substantially from 1500 to 1600° C. After that, a glass material was prepared by quenching the obtained melted material.

Next, glass powder was prepared by pulverizing the glass material so that the average particle diameter $D_{50}$ lay in a range substantially from 1 μm to 3 μm. In addition, quartz powder and alumina powder both having an average particle diameter $D_{50}$ in a range substantially from 0.5 μm to 2.0 μm were prepared as fillers. Here, the average particle diameter $D_{50}$ is a particle diameter corresponding to a volume-based cumulative percentage of 50%. Next, a glass ceramic material was prepared by adding the quartz and alumina powders as fillers to the glass powder.

Preparation of Glass Ceramic Sheets

A ceramic slurry was prepared by adding the glass ceramic material to a ball mill along with an organic binder such as polyvinyl butyral resin, an organic solvent such as ethanol or toluene, a plasticizer, a PSZ medium and so forth and then mixing the materials together. Glass ceramic sheets were prepared by forming the ceramic slurry into a sheet-like shape having a thickness in a range substantially from 20 μm to 30 μm using a doctor blade method or the like and then punching substantially rectangular shapes out of the sheet.

Formation of Conductor Patterns

Coil-conductor conductor patterns corresponding to the coil conductors illustrated in FIG. 2, lead-out-electrode conductor patterns corresponding to the lead-out electrodes illustrated in FIG. 2, and via-conductor conductor patterns corresponding to the via conductors illustrated in FIG. 2 are formed on and in the glass ceramic sheets by performing screen printing using a Ag paste. When forming the via-conductor conductor patterns, via holes were formed first by irradiating predetermined regions of the glass-ceramic sheets with a laser and then the thus-formed via holes were filled with an electrically conductive paste.

Preparation of Multilayer Block

The glass ceramic sheets having the conductor patterns formed thereon and therein were stacked in the order illustrated in FIG. 2. A prescribed number of glass ceramic sheets having no conductor patterns formed thereon or therein were stacked on the top and bottom of this multilayer body. After that, a multilayer block was prepared by subjecting the obtained multilayer body to pressure bonding using a warm isostatic press process or the like. The pressure bonding conditions were a temperature of 80° C. and a pressure of 100 MPa.

Preparation of Element Body

Individual chips were prepared by cutting the multilayer block into pieces of a prescribed size using a dicer or the like. Then, the individual chips were fired for 1.5 hours at 880° C. and as a result, the glass ceramic sheets became the insulating layers and the coil-conductor conductor patterns, the lead-out-electrode conductor patterns, and the via-conductor conductor patterns became the coil conductors, the lead-out electrodes, and the via conductors. As a result, element bodies each having the first coil and the second coil buried therein as illustrated in FIG. 2 were prepared.

The prepared element body had a first end surface and a second end surface that faced each other in the length direction, a first side surface and a second side surface that faced each other in the width direction, and a first main surface and a second main surface that faced each other in the height direction. In this example, the second main surface of the element body was served as the mounting surface.

Furthermore, the first lead-out electrode, which was connected to one end of the first coil, and the third lead-out electrode, which was connected to one end of the second coil, were exposed at the first side surface of the element body. The second lead-out electrode, which was connected to the other end of the first coil, and the fourth lead-out electrode, which was connected to the other end of the second coil, were exposed at the second side surface of the element body. In other words, in this example, the first side surface and the second side surface of the element body served as coil lead-out surfaces.

Next, the edge portions and corner portions of the element body were rounded by placing the element body in a rotary barrel machine together with a medium and performing barrel polishing.

Formation of Outer Electrodes

An electrically conductive paste containing Ag and glass frit was applied to at least the four places where the lead-out electrodes were exposed on both side surfaces of the element body. Then, base electrode layers were formed by baking the thus-obtained films at 810° C. for 1 minute. The thickness of the base electrode layers was 5 μm. Next, a Ni plating film and a Sn plating film were sequentially formed by performing electrolytic plating on the base electrode layers. The thicknesses of the Ni plating film and the Sn plating film were 3 μm. As a result, the first outer electrode, the second outer electrode, the third outer electrode, and the fourth outer electrode as illustrated in FIG. 1 were formed.

The multilayer coil component of example 1 was manufactured as described above.

Regarding the size of each multilayer coil component, the dimension in the length direction was 0.6 mm, the dimension in the width direction was 0.5 mm, and the dimension in the height direction was 0.3 mm.

For each multilayer coil component, the dead weight was 0.25 mg, as measured using the above-described method.

For each multilayer coil component, the radius of curvature of the first edge portion where the second main surface, which was the mounting surface, and the first side surface, which was a coil lead-out surface, intersect was 13 μm, as measured using the above-described method. In addition, the radius of curvature of the second edge portion where the second main surface, which was the mounting surface, and the second side surface, which was a coil lead-out surface, intersect was 13 μm.

For each multilayer coil component, the sum of the dimensions W11 and W12, the sum of the dimensions W21 and W22, the sum of the dimensions W31 and W32, and the sum of the dimensions W41 and W42, as illustrated in FIGS. 4 and 5, as measured using the above-described method, were each 140 μm.

Example 2

A multilayer coil component of example 2 was manufactured in the same way as the multilayer coil component of example 1 except that the following specifications were adopted.

The radii of curvature of the first edge portion and the second edge portion were 18 μm.

Example 3

A multilayer coil component of example 3 was manufactured in the same way as the multilayer coil component of example 1 except that the following specification was adopted.

The radii of curvature of the first edge portion and the second edge portion were 20 μm.

Example 4

A multilayer coil component of example 4 was manufactured in the same way as the multilayer coil component of example 1 except that the following specifications were adopted.

The radii of curvature of the first edge portion and the second edge portion were 23 μm.

Example 5

A multilayer coil component of example 5 was manufactured in the same way as the multilayer coil component of example 1 except that the following specifications were adopted.

The radii of curvature of the first edge portion and the second edge portion were 23 μm.

The sum of the dimension W11 and the dimension W12, the sum of the dimension W21 and the dimension W22, the sum of the dimension W31 and the dimension W32, and the sum of the dimension W41 and the dimension W42 were each 70 μm.

Example 6

A multilayer coil component of example 6 was manufactured in the same way as the multilayer coil component of example 1 except that the following specifications were adopted.

The radii of curvature of the first edge portion and the second edge portion were 26 μm.

Example 7

A multilayer coil component of example 7 was manufactured in the same way as the multilayer coil component of example 1 except that the following specifications were adopted.

The radii of curvature of the first edge portion and the second edge portion were 26 μm.

The sum of the dimension W11 and the dimension W12, the sum of the dimension W21 and the dimension W22, the sum of the dimension W31 and the dimension W32, and the sum of the dimension W41 and the dimension W42 were each 70 μm.

Example 8

A multilayer coil component of example 8 was manufactured in the same way as the multilayer coil component of example 1 except that the following specifications were adopted.

The radii of curvature of the first edge portion and the second edge portion were 30 μm.

Example 9

A multilayer coil component of example 9 was manufactured in the same way as the multilayer coil component of example 1 except that the following specifications were adopted.

The radii of curvature of the first edge portion and the second edge portion were 30 μm.

The sum of the dimension W11 and the dimension W12, the sum of the dimension W21 and the dimension W22, the sum of the dimension W31 and the dimension W32, and the sum of the dimension W41 and the dimension W42 were each 70 μm.

Example 10

A multilayer coil component of example 10 was manufactured in the same way as the multilayer coil component of example 1 except that the following specifications were adopted.

The dead weight was 0.2 mg.

The radii of curvature of the first edge portion and the second edge portion were 23 μm.

The sum of the dimension W11 and the dimension W12, the sum of the dimension W21 and the dimension W22, the sum of the dimension W31 and the dimension W32, and the sum of the dimension W41 and the dimension W42 were each 100 μm.

Example 11

A multilayer coil component of example 11 was manufactured in the same way as the multilayer coil component of example 1 except that the following specifications were adopted.

The dead weight was 0.35 mg.

The radii of curvature of the first edge portion and the second edge portion were 23 μm.

Comparative Example 1

A multilayer coil component of comparative example 1 was manufactured in the same way as the multilayer coil component of example 1 except that the following specifications were adopted.

The radii of curvature of the first edge portion and the second edge portion were 35 μm.

Comparative Example 2

A multilayer coil component of comparative example 2 was manufactured in the same way as the multilayer coil component of example 1 except that the following specifications were adopted.

The dead weight was 0.38 mg.

The radii of curvature of the first edge portion and the second edge portion were 35 μm.

Evaluation

The incidence of the tombstone phenomenon at the time of mounting was evaluated using the following method for the multilayer coil components of examples 1 to 11 and comparative examples 1 and 2.

Figure 7:
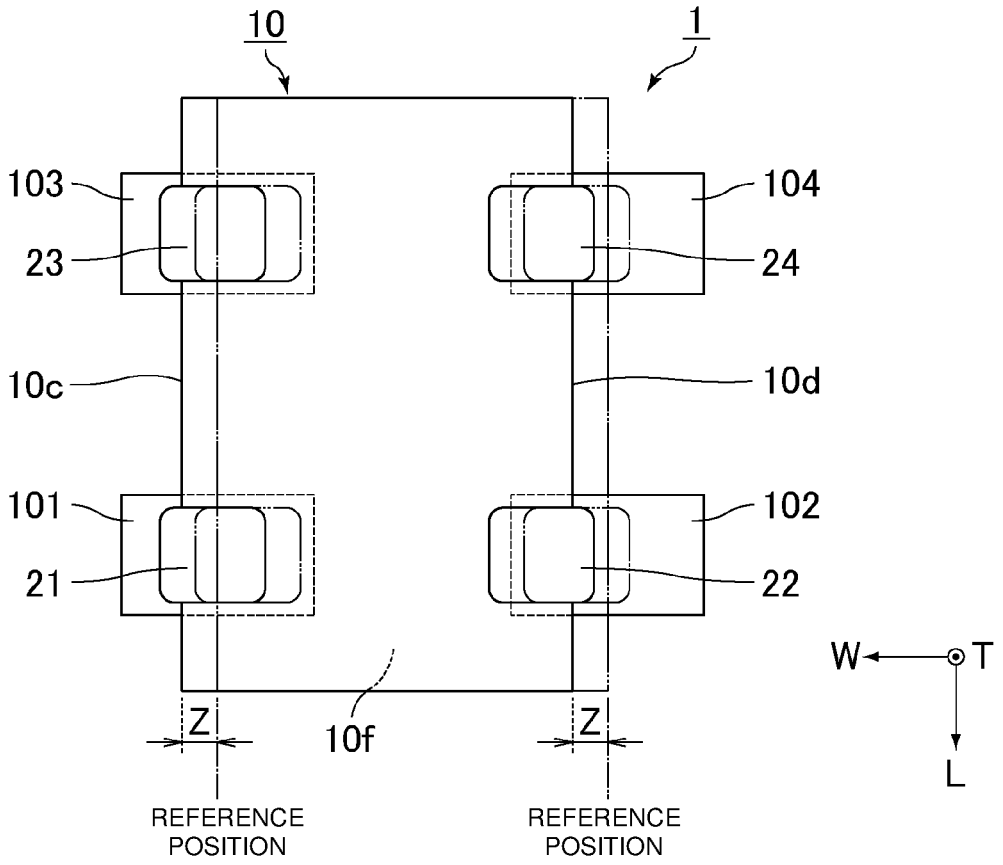
FIG. 7 is a schematic plan view for explaining a method of evaluating the incidence of the tombstone phenomenon when mounting a multilayer coil component.

FIG. 7 is a schematic plan view for explaining the method of evaluating the incidence of the tombstone phenomenon when mounting a multilayer coil component. As illustrated in FIG. 7, the multilayer coil component 1 was mounted on a wiring substrate from the second main surface 10*f* side of the element body 10 by respectively bonding the first outer electrode 21, the second outer electrode 22, the third outer electrode 23, and the fourth outer electrode 24 to a first land 101, a second land 102, a third land 103, and a fourth land 104 of the wiring substrate via solder. At this time, the mounting position of the multilayer coil component 1 was shifted from a reference position by a shift amount Z in the width direction W.

At the reference position of the multilayer coil component 1, the first side surface 10*c* of the element body 10 extends through the center of the first land 101 and the center of the third land 103 in the width direction W and the second side surface 10*d* of the element body 10 extends through the center of the second land 102 and the center of the fourth land 104 in the width direction W in a plan view as illustrated in FIG. 7. The shift amount Z was 100 μm.

The multilayer coil component 1 was shifted in order to create conditions where the tombstone phenomenon would be likely to occur, as described below. In the plan view illustrated in FIG. 7, the region where the second outer electrode 22 and the second land 102 overlap with solder therebetween becomes narrower than the region where the first outer electrode 21 and the first land 101 overlap with solder therebetween, and the region where the fourth outer electrode 24 and the fourth land 104 overlap with solder therebetween becomes narrower than the region where the third outer electrode 23 and the third land 103 overlap with solder therebetween. Therefore, the balance between the tensile forces acting on the first outer electrode 21 and the second outer electrode 22 from the solder is likely to be disturbed and the balance between the tensions acting on the third outer electrode 23 and the fourth outer electrode 24 from the solder is likely to be disturbed. As a result, the second outer electrode 22 and the fourth outer electrode 24 are more likely to become separated from the wiring substrate and therefore this is a condition where the tombstone phenomenon is likely to occur.

As described above, the incidence of the tombstone phenomenon in a state where the mounting position of the multilayer coil component was shifted was evaluated. The obtained results are illustrated in Table 1. When evaluating the incidence of the tombstone phenomenon, between 240 and 300 of each of the multilayer coil components of examples 1 to 11 and comparative examples 1 and 2 were checked.

In Table 1, the radii of curvature of the first edge portions and the second edge portions are collectively referred to as "radii of curvature of edge portions". Furthermore, the sum of the dimension W11 and the dimension W12, the sum of the dimension W21 and the dimension W22, the sum of the dimension W31 and the dimension W32, and the sum of the dimension W41 and the dimension W42 are collectively referred to as "dimensions of outer electrodes".

TABLE 1

| | SPECIFCATIONS | | | INCIDENCE OF TOMBSTONE |
|---|---|---|---|---|
| | DEAD WEIGHT (mg) | RADII OF CURVATURE OF EDGE PORTIONS (μm) | DIMENSIONS OF OUTER ELECTRODES (μm) | PHENOMENON (%) SHIFT AMOUNT: 100 μm |
| EXAMPLE 1 | 0.25 | 13 | 140 | 0.79 |
| EXAMPLE 2 | 0.25 | 18 | 140 | 0 |
| EXAMPLE 3 | 0.25 | 20 | 140 | 1.60 |
| EXAMPLE 4 | 0.25 | 23 | 140 | 1.11 |
| EXAMPLE 5 | 0.25 | 23 | 70 | 0.35 |
| EXAMPLE 6 | 0.25 | 26 | 140 | 1.12 |
| EXAMPLE 7 | 0.25 | 26 | 70 | 1.50 |
| EXAMPLE 8 | 0.25 | 30 | 140 | 1.26 |
| EXAMPLE 9 | 0.25 | 30 | 70 | 1.37 |
| EXAMPLE 10 | 0.2 | 23 | 100 | 1.50 |
| EXAMPLE 11 | 0.35 | 23 | 140 | 0 |
| COMPARATIVE EXAMPLE 1 | 0.25 | 35 | 140 | 8.40 |
| COMPARATIVE EXAMPLE 2 | 0.38 | 35 | 140 | 5.33 |

As illustrated in Table 1, the incidence of the tombstone phenomenon was lower for the multilayer coil components of examples 1 to 11 than for the multilayer coil components of comparative examples 1 and 2. Therefore, it is clear that the multilayer coil components of examples 1 to 11 are not susceptible to the tombstone phenomenon even when the mounting position is significantly shifted when mounting the multilayer coil components.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

an element body formed by stacking a plurality of insulating layers on top of one another;

a coil that is buried inside the element body; and an outer electrode that is electrically connected to the coil;

wherein a dead weight of the multilayer coil component is in a range from 0.2 mg to 0.35 mg, the element body has a mounting surface and has a coil lead-out surface to which the coil is electrically led out and on which the outer electrode is provided, and when viewed at a cross section of the element body that is perpendicular to the mounting surface and the coil lead-out surface, a radius of curvature of an edge portion where the mounting surface and the coil lead-out surface intersect is in a range from 13 μm to 30 μm.

2. The multilayer coil component according to claim 1, wherein the outer electrode extends from the coil lead-out surface onto the mounting surface, and when viewed at a cross section perpendicular to the mounting surface and the coil lead-out surface, a sum of a dimension, in a direction parallel to the mounting surface, of a part of the outer electrode on the coil lead-out surface and a dimension of a part of the outer electrode that extends along the mounting surface is in a range from 70 μm to 140 μm.

3. The multilayer coil component according to claim 1, wherein the element body has a pair of the coil lead-out surfaces that face each other, and a distance between the pair of coil lead-out surfaces is in a range from 0.45 mm to 0.55 mm.

4. The multilayer coil component according to claim 1, wherein the insulating layers are made of a glass ceramic material.

5. The multilayer coil component according to claim 1, wherein the multilayer coil component is a common mode choke coil.

6. The multilayer coil component according to claim 2, wherein the element body has a pair of the coil lead-out surfaces that face each other, and a distance between the pair of coil lead-out surfaces is in a range from 0.45 mm to 0.55 mm.

7. The multilayer coil component according to claim 2, wherein the insulating layers are made of a glass ceramic material.

8. The multilayer coil component according to claim 3, wherein the insulating layers are made of a glass ceramic material.

9. The multilayer coil component according to claim 6, wherein the insulating layers are made of a glass ceramic material.

10. The multilayer coil component according to claim 2, wherein the multilayer coil component is a common mode choke coil.

11. The multilayer coil component according to claim 3, wherein the multilayer coil component is a common mode choke coil.

12. The multilayer coil component according to claim 4, wherein the multilayer coil component is a common mode choke coil.

13. The multilayer coil component according to claim 6, wherein the multilayer coil component is a common mode choke coil.

14. The multilayer coil component according to claim 7, wherein the multilayer coil component is a common mode choke coil.

15. The multilayer coil component according to claim 8, wherein the multilayer coil component is a common mode choke coil.

16. The multilayer coil component according to claim 9, wherein the multilayer coil component is a common mode choke coil.

* * * * *